US006984028B2

(12) United States Patent
Steiner

(10) Patent No.: US 6,984,028 B2
(45) Date of Patent: Jan. 10, 2006

(54) METHOD FOR CONDITIONING INKJET FLUID DROPLETS USING LAMINAR AIRFLOW

(75) Inventor: Thomas W. Steiner, Burnaby (CA)

(73) Assignee: Creo Inc., Burnaby (CA)

( * ) Notice: Subject to any disclaimer, the term of this patent is extended or adjusted under 35 U.S.C. 154(b) by 72 days.

(21) Appl. No.: 10/602,819

(22) Filed: Jun. 25, 2003

(65) Prior Publication Data

US 2004/0263586 A1 Dec. 30, 2004

(51) Int. Cl.
*B41J 2/07* (2006.01)

(52) U.S. Cl. ..... 347/74
(58) Field of Classification Search ..... 347/73, 347/74, 75–83
See application file for complete search history.

(56) References Cited

U.S. PATENT DOCUMENTS 3,596,275 A 7/1971 Sweet
3,836,913 A * 9/1974 Burnett et al. ..... 347/74
3,955,203 A 5/1976 Chocholaty
3,972,051 A * 7/1976 Lundquist et al. ..... 347/74
4,097,872 A 6/1978 Giordano et al. ..... 347/21
4,292,640 A * 9/1981 Lammers et al. ..... 347/21
4,297,712 A 10/1981 Lammers et al.
6,572,223 B2 * 6/2003 Delametter et al. ..... 347/82

FOREIGN PATENT DOCUMENTS

EP 1 319 510 A1 6/2003
JP 55126465 9/1980
JP 58 005625 1/1983

* cited by examiner

*Primary Examiner*—K. Feggins
(74) *Attorney, Agent, or Firm*—Oyen Wiggs Green & Mutala

(57) ABSTRACT

A multirow multinozzle continuous inkjet head comprises a plurality of rows of inkjet nozzles ejecting drops in regions of airflow velocity within a collinear flow of air. The airflow velocity at all nozzles is equal, but lower than the highest airflow velocity within the collinear flow of air. This allows many more drop streams to be placed in a velocity-matched airstream. Despite the drops being in regions with air velocity gradients across the drops, it is found that the lateral forces are such that droplet placement on the print media surface is accurate and well controlled.

53 Claims, 2 Drawing Sheets

METHOD FOR CONDITIONING INKJET FLUID DROPLETS USING LAMINAR AIRFLOW

CROSS-REFERENCES TO RELATED APPLICATIONS

Field of the Invention

The invention pertains to the field of inkjetting of fluids and, in particular, to the conditioning of fluid droplets using laminar airflow

BACKGROUND OF THE INVENTION

The use of ink jet printers for printing information on a recording media is well established. Printers employed for this purpose may be grouped into those that use a continuous stream of fluid droplets and those emit droplets only when corresponding information is to be printed. The former group is generally known as continuous inkjet printers and the latter as drop-on-demand inkjet printers. The general principles of operation of both of these groups of printers are very well recorded. Drop-on-demand inkjet printers have become the predominant type of printer for use in home computing systems, while continuous inkjet systems find major application in industrial and professional environments.

Continuous inkjet printers typically have a print head that incorporates a supply line or system for ink fluid and a nozzle plate with one or more ink nozzles fed by the ink fluid supply. A gutter assembly is positioned downstream from the nozzle plate in the flight path of ink droplets to be guttered. The gutter assembly catches ink droplets that are not needed for printing on the recording medium.

In order to create the ink droplets, a drop generator is associated with the print head. The drop generator influences, by a variety of mechanisms discussed in the art, the fluid stream within and just beyond the print head. This is done at a frequency that forces thread-like streams of ink, which are initially ejected from the nozzles, to be broken up into a series of ink droplets at a point within the vicinity of the nozzle plate. A charge electrode is positioned along the flight path of the ink droplets. The function of the charge electrode is to selectively charge the ink droplets as the droplets break off from the jet. One or more deflection plates positioned downstream from the charge electrodes deflect a charged ink droplet either into the gutter or onto the recording media. For example, the droplets to be guttered are charged and hence deflected into the gutter assembly and those intended to print on the media are not charged and hence not deflected. In some systems, the arrangement is reversed, and the uncharged droplets are guttered, while the charged ones ultimately are printed.

One of the problems associated with continuous ink jet printers is that of ink droplet misregistration at the recording surface. The ink droplet misregistration arises from interaction between the droplets as they are propelled along a flight path towards the recording surface. One of the prime causes for droplet interaction is the aerodynamic drag on the respective droplets. Unless the air velocity matches the drop velocity, the local airflow around the drop is affected by the passage of the drop and this will affect the dynamics of trailing drops. The aerodynamic interaction affects the relative spacing between droplets because it either increases or decreases the velocity of the droplets. As a result, some ink droplets reach the media early while others reach the media late. Drops may even merge in flight. The trailing drops may also experience lateral forces when following a drop on a different deflected trajectory. The overall effect is that the presence of the aerodynamic interaction, also called the aerodynamic drag, results in relatively poor printing quality due to droplet misplacement on the media. In multinozzle print heads the aerodynamic drag also creates the additional problem of variation in droplet velocity from fluid droplet stream to fluid droplet stream, resulting in further inaccuracies in droplet placement on the media, and consequent poor printing quality.

To address the aerodynamic interaction problem, the prior art utilizes a gas stream, such as air, to compensate for the aerodynamic drag on the ink droplets. The air flows collinearly with the stream of ink droplets and reduces the aerodynamic effect. The inkjet nozzle is generally mounted to eject the droplets into the center of the air stream. In an extension of this approach, laminar airflow has also been applied to multinozzle heads. This is generally done by using a single row of nozzles.

The prior art is generally characterized by the placement of a single nozzle centrally in the highest velocity zone of the laminar airflow column. This is done to minimize any forces that may deviate the flight path of the droplets laterally. Laminar flow systems for single rows of multiple inkjet nozzles have also been described in the prior art, the nozzles again being placed centrally in the highest velocity zone of the laminar airflow column. While multirow multinozzle continuous inkjet systems have indeed been proposed, they have not seen the benefit of laminar airflow, due to the above anticipated negative consequences of droplet placement anywhere but in the uniform highest airflow velocity area of the system where the airflow velocity profile is suitably flat. As a result, the inkjet printer designs suggested for multirow multinozzle systems are subject to serious droplet misregistration problems.

BRIEF SUMMARY OF THE INVENTION

A multirow multinozzle continuous inkjet head comprises a plurality of rows of inkjet nozzles ejecting fluid droplets in regions of airflow velocity within a collinear flow of air. The airflow velocity at all droplet trajectories is substantially equal, but lower than the highest airflow velocity within the collinear flow of air. This allows many more droplet streams to be placed in a velocity-matched airstream. Despite the droplets being in regions with air velocity gradients across the droplets, it is found that the lateral forces are such that droplet placement on the print media surface is accurate and well controlled.

DETAILED DESCRIPTION OF THE PREFERRED EMBODIMENTS

Figure 1:
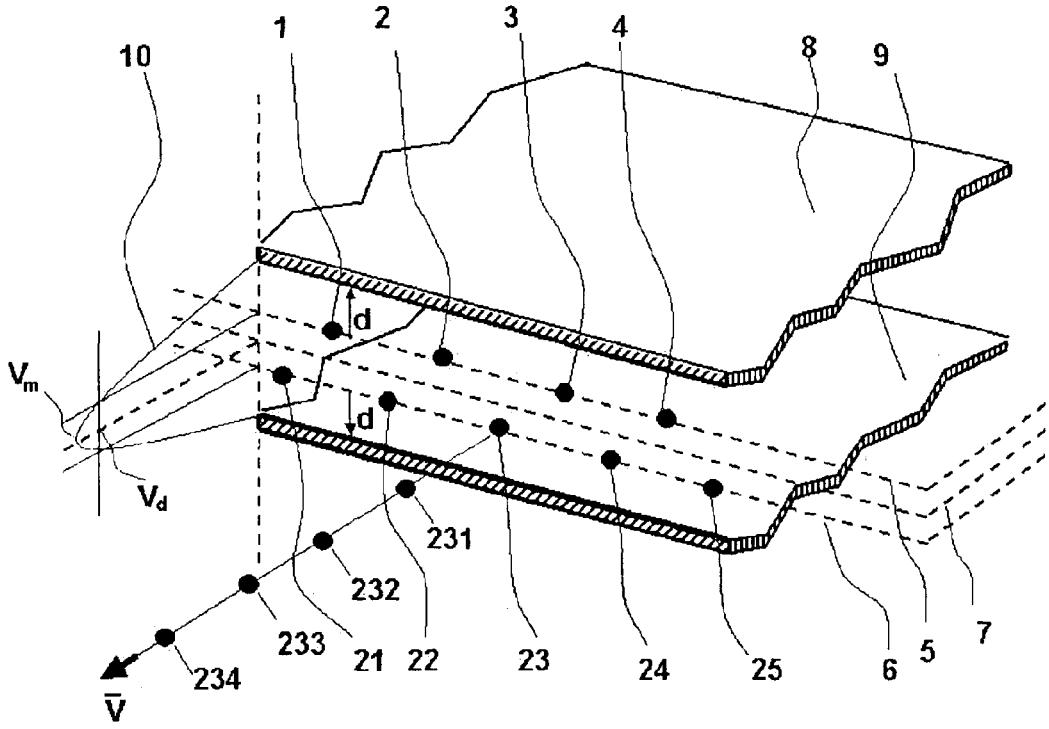
FIG. 1 shows inkjet fluid droplets moving collinearly within a column of air that has a velocity distribution that is symmetrical with respect to a plane within the column.

FIG. 1 shows a preferred embodiment of the present invention. Inkjet fluid droplets 1, 2, 3 and 4 are moving in plane 5 in the direction of vector v, as indicated by the arrow, at an equal distance d from plate 8. Inkjet fluid droplets 21, 22, 23, 24 and 25 are moving collinearly with inkjet fluid droplets 1, 2, 3 and 4 in plane 6 in the direction of vector v, as indicated by the same arrow, at an equal distance d from plate 9. A substantially collinear flow of air is established by forcing air to flow substantially collinearly with both rows of droplets in the direction of vector v, as indicated by the arrow. The inkjet fluid droplets are emitted from inkjet nozzles into the collinear flow of air. In the substantially collinear air flow, the airflow is approximately aligned in direction with the path of the drop over the majority of the course of its flight from ejection to deposition on the recording surface, to the degree that when speeds are approximately matched over the path, the relative velocity of air and drop is sufficiently small to reduce aerodynamic drag effects on the drop, such that drop placement accuracy on the printed surface is measurably improved. Since the various technologies of inkjet fluid droplet emission are well-known to those skilled in the art, they are not discussed further here and the nozzles are not shown in the figures. The systems controller or controllers that are required to control the velocity of the emitted inkjet fluid droplets, as well as the airflow in the laminar airflow duct, are also well-known to those skilled in the art. They are therefore not shown in the figures and will not be further discussed in the present application for letters patent. The four inkjet fluid droplets of the first row and the five inkjet fluid droplets of the second row are chosen to be representative of a much larger number of droplets moving in exactly the same fashion. For the sake of clarity each train of inkjet fluid droplets moving between the two plates 8 and 9 is represented by a single droplet in FIG. 1, whereas, in fact, each train is comprised of many droplets traveling one behind the other. One of the trains of inkjet fluid droplets, that of which inkjet fluid droplet 23 is part, is shown to comprise inkjet fluid droplets 23, 231, 232, 233 and 234.

To the extent that plates 8 and 9 both extend much further in all directions of their planes, the airflow velocity profile is described by curve 10. Plates 8 and 9 are combined with further plates, not shown in FIG. 1 and positioned at a large distance compared with distance d, to constitute a defined space within which the collinear flow of air is established. This defined space functions as a collinear airflow duct. A maximum airflow velocity $v_m$ obtains halfway between plates 8 and 9, and the airflow velocity profile is symmetrical about this halfway point given by plane 7. The airflow velocity profile is determined by a number of factors. Chiefly, the controlling boundary condition is that the velocity will be zero at the inner surfaces of planes 8 and 9 and will increase towards the halfway point. Furthermore, the dimensions and velocity must be such that the resulting Reynolds number is low enough to allow purely laminar flow. The means for injecting and charging inkjet fluid droplets, as well as the means for establishing a collinear flow of air, and ensuring that the airflow velocity in the vicinity of the droplets and the droplet velocity are substantially matched, are all well known in the art and will not be further discussed in the present application for letters patent. The matching of these velocities may be accomplished by adjusting the droplet velocity, or the regional airflow velocity, or both.

In the prior art, inkjet nozzles would be positioned such that the droplets travel precisely halfway between plates 8 and 9 in the maximum airflow velocity region given by plane 7, where the curve peaks. Within this small region, the airflow velocity profile is substantially flat and the inkjet fluid droplets are considered stable in their paths. The substantially flat region of the velocity profile occurs where small variations in velocity exist across the drop for nominal positions around the peak, such that for small variations in position of the stream in said substantially flat region of the velocity profile, insignificant aerodynamic forces are acting upon the drop stream.

In order to make a continuous inkjet printer that has more than one row of nozzles, the designer is confronted by the fact that a plurality of rows cannot be in the maximum airflow velocity region of plane 7. If the rows are not in that area, then, because of the airflow velocity profile, they have to be in areas where the airflow velocity actually varies significantly over the dimensions of a single droplet. The droplets would experience a faster airflow speed at their inner surfaces than at their outer surfaces, the term outer surface being used here to describe the surface of the inkjet fluid droplet facing away from the region of highest airflow velocity. Conversely, the term inner surface is used here to describe the surface of the inkjet fluid droplet that faces toward the highest airflow velocity region. By way of example, the outer surfaces of inkjet fluid droplets 4 and 24 face away from plane 7, while the inner surfaces of inkjet fluid droplets 4 and 24 face toward plane 7. This variation in airflow velocity across an inkjet fluid droplet will cause the drops to spin and be subject to lateral forces that may prevent drops from being directed to the gutter or cause misregistration on the printed media.

The present inventors have found that drop to drop aerodynamic interactions can be reduced to negligible levels while-lateral forces, although present, are are such that droplet placement on the print media surface is accurate and well controlled. By ensuring that the two rows of inkjet fluid droplets are at the same distance from plates 8 and 9 respectively, the droplets are emitted into regions of the collinear flow of air where the regional airflow velocities at the droplets are at substantially the same value $v_d$, which is specifically lower than the maximum airflow velocity $v_m$. In one preferred embodiment of the present invention the spacing between plates 8 and 9 is 230 microns, while the two rows of nozzles emit droplets to travel at precisely 60 microns from the plates, one row at 60 microns from plate 8 in plane 5 and the other at 60 microns from plate 9 in plane 6. The airflow velocity is set to approximately 30 meters per second. In order to obtain maximal resolution in printing, the droplets in the two rows do not travel directly above one another, but are staggered as shown in FIG. 1. This allows double the resolution that may be obtained printing with a single row.

Figure 2:
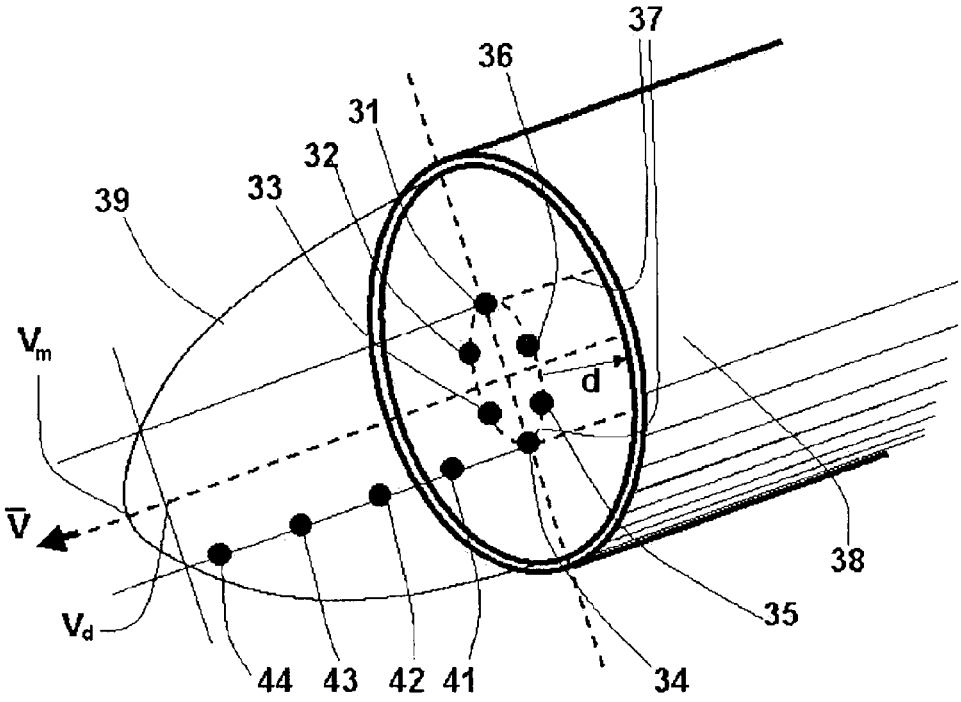
FIG. 2 shows inkjet fluid droplets moving collinearly within a column of air that has a velocity distribution that is cylindrically symmetrical with respect to a line down the centre of the column.

In a further embodiment of the present invention, shown in FIG. 2, inkjet fluid droplets 31, 32, 33, 34, 35 and 36 are moving in the direction of vector v, as indicated by the arrow, within cylindrical surface 37 at a radial distance d from cylinder 38. Air is forced to flow collinearly with the inkjet fluid droplets within the defined space defined by a collinear airflow duct in the form of cylinder 38 in the direction of vector v, as indicated by the arrow. The inkjet fluid droplets are therefore emitted into a region of the collinear flow of air that is defined by a thin cylindrical shell of air, cylindrically symmetric with the cylinder 38 and of radius that is smaller than that of cylinder 38 by an amount d. In this particular case, the six inkjet fluid droplets are chosen to be representative of a potentially different number of droplets moving in exactly the same fashion within the same selected air region where they travel collinearly at substantially the same regional airflow velocity $v_d$, which is less than the maximum airflow velocity $v_m$. For the sake of clarity, each train of inkjet fluid droplets is represented by a single droplet in FIG. 2, whereas, in fact, each train is comprised of many droplets traveling one behind the other. One of the trains of inkjet fluid droplets, that of which inkjet fluid droplet 34 is part, is shown to comprise inkjet fluid droplets 41, 42, 43, 44 and 45.

The airflow velocity profile is described by curve 9 and the maximum airflow velocity $v_m$ obtains at the center of the cylinder. The that the velocity will be zero at the inner surface of cylinder 8 and will increase towards the center of the cylinder. The inkjet fluid droplets are therefore traveling in a region that has an airflow velocity distinctly smaller than the maximum airflow velocity.

In the prior art, this laminar flow configuration could only be employed for use with a single train of inkjet fluid droplets moving precisely down the center of the cylinder in the maximum airflow velocity zone. Within this small region, the prior art considered the velocity profile suitably flat and the inkjet fluid droplets were considered stable in their paths.

It is clear that, in a more generalized embodiment, the cross-section of the defined space, perpendicular to the collinear flow of air, may have a random two-dimensional shape. There will be a distinct airflow velocity profile, but it will always be possible to select regions in which the regional airflow velocity is equal, but lower than the maximum airflow velocity. A plurality of rows of inkjet nozzles may be placed such as to emit inkjet fluid droplets into the region or regions of equal regional airflow velocity. The case of a cylindrical cross-section is merely a very special case in which these regions assume the shape of a cylindrical shell. In the general case of the present invention, the term "outer surface" describes that surface of an inkjet fluid droplet that faces away from the highest airflow velocity region within the collinear airflow duct. The term "inner surface" describes that surface of an inkjet fluid droplet that faces towards the highest airflow velocity region within the collinear airflow duct. Since the timing of the emission of inkjet fluid droplets into the selected air regions is at the discretion of the designer, it may be selected such as to ensure that a given inkjet fluid droplet will deposit onto the media being printed upon at exactly the desired point at the desired time. This allows an entirely generalised distribution of nozzles to be employed to print the required information with correct registration. In this embodiment of the present invention, the arrangement of nozzles may, in general, be non-linear and non-circular.

In a further embodiment of the present invention, most easily described at the hand of a cylindrical system, two or more regional airflow velocities are selected, and inkjet fluid droplets are emitted into these different regions at velocities substantially matched with the respective regional airflow velocities. In the case of a cylindrically shaped laminar airflow duct, such a system therefore may have a group of two or more concentric regions of regional airflow velocity, with the innermost of these regions having the highest regional airflow velocity and the outermost one having the lowest regional airflow velocity. Since the regional airflow velocities can be measured accurately and the droplet emission speeds adapted, the timing of the emission of the inkjet fluid droplets may be made intentionally different amongst the different regions to compensate for the variation in regional airflow velocity amongst member regions of the group. In this cylindrical embodiment, the nozzles from which the inkjet fluid droplets are emitted will clearly be arranged in concentric circles.

In a further embodiment of the present invention, an airflow duct of non-uniform cross section may be constructed to obtain regional airflow velocity that is substantially collinear to the drop trajectory. Although airflow collinear with the intended drop trajectory may be obtained with laminar flow in a duct of fixed cross section across the flow direction, a substantially collinear flow may exist in an airflow duct with changing cross section along the direction of flow. In one particular embodiment, said duct may be formed by two planes as in the rectangular duct of FIG. 1, but with planes 8 and 9 being non-parallel and decreasing in separation toward the recording surface. This converging duct may still maintain laminar flow but will have airflow velocity that is increasing in magnitude and may change in direction toward the outlet at the recording surface. Drops are directed into this substantially collinear airflow duct such that on average the relative velocity between the drops and the converging airflow is sufficiently small to reduce aerodynamic interactions to the level where improved drop placement accuracy on the recording surface is obtained.

In yet another particular embodiment, the duct may be formed by two planes as in the rectangular duct of FIG. 1, but with planes 8 and 9 being non-parallel and increasing in separation toward the recording surface. This described diverging duct may still maintain laminar flow but will have airflow velocity that is changing in direction and decreasing in magnitude toward the outlet at the recording surface. Drops are directed into this airflow such that on average the relative velocity between said drops and the converging airflow is sufficiently small as described above.

The use of multiple regional airflow velocities may be extended to the other configurations already described in the present application for letters patent. In the case of a laminar airflow duct having a rectangular configuration, the inkjet nozzles might be arranged in a plurality of parallel rows in order to eject their inkjet fluid droplets into the various regional airflow velocity zones. In an embodiment having a laminar airflow duct of more generalized cross-section, the arrangement of the nozzles might be correspondingly more generalized to ensure that a given subset of nozzles emit their inkjet fluid droplets into a region of substantially matched regional airflow velocity.

While the different embodiments of the present invention, as described thus far in the present application for letters patent, are based on continuous inkjet systems, the several advantages of the invention apply equally to drop-on-demand inkjet systems, where inkjet fluid droplets are emitted only when they are intended to print onto the media being printed upon. Such systems therefore have no requirement for guttering and all emitted inkjet fluid droplets travel within the collinear flow of air. Drop-on-demand systems are particularly amenable to implementations in which more than one regional airflow velocity is selected for inkjet fluid droplet injection.

There have thus been outlined the important features of the invention in order that it may be better understood, and in order that the present contribution to the art may be better appreciated. Those skilled in the art will appreciate that the conception on which this disclosure is based may readily be utilized as a basis for the design of other methods and apparatus for carrying out the several purposes of the invention. It is most important, therefore, that this disclosure be regarded as including such equivalent methods and apparatus as do not depart from the spirit and scope of the invention.

What is claimed is:

1. A method for depositing fluid droplets on a surface, the method comprising:

establishing a flow of air substantially collinear with a trajectory of fluid droplets emitted by each of one or more droplet emitters, the flow of air having a velocity profile characterized by a maximum airflow velocity; and emitting at least one fluid droplet into a first region of the flow of air, the first region having a first regional airflow velocity lower than the maximum airflow velocity.

2. A method according to claim 1, comprising substantially matching a velocity at which the at least one fluid droplet is emitted into the first region with the first regional airflow velocity.

3. A method according to claim 1 wherein emitting at least one fluid droplet into the first region comprises emitting fluid droplets from a plurality of nozzles into the first region.

4. A method according to claim 1 wherein emitting at least one fluid droplet into the first region comprises emitting the at least one fluid droplet from a first nozzle into the first region and wherein the method comprises emitting at least one additional fluid droplet from a second nozzle into a second region of the flow of air, the second region having a second regional airflow velocity lower than the maximum airflow velocity.

5. A method according to claim 4 wherein the first and second regional airflow velocities are equal to one another.

6. A method according to claim 5 wherein the first and second regions are on opposed sides of a third region of the flow of air and wherein the flow of air has the maximum airflow velocity in the third region.

7. A method according to claim 6 wherein the first and second regions are symmetrically disposed with respect to the third region.

8. A method according to claim 4 wherein the first and second regional airflow velocities are different from one another.

9. A method according to claim 4 comprising substantially matching a velocity at which the at least one fluid droplet is emitted into the first region with the first regional airflow velocity.

10. A method according to claim 9 comprising substantially matching a velocity at which the at least one additional fluid droplet is emitted into the second region with the second regional airflow velocity.

11. A method according to claim 4 wherein the flow of air has a first velocity gradient in the first region.

12. A method according to claim 11 wherein the flow of air has a second velocity gradient in the second region.

13. A method according to claim 1 wherein emitting at least one fluid droplet into the first region comprises emitting the at least one fluid droplet from at least one first row of a plurality of rows of nozzles into the first region and wherein the method comprises emitting at least one additional fluid droplet from at least one second row of the plurality of rows of nozzles into a second region of the flow of air, the second region having a second regional airflow velocity lower than the maximum airflow velocity.

14. A method according to claim 13 comprising substantially matching a velocity at which the at least one fluid droplet is emitted into the first region with the first regional airflow velocity.

15. A method according to claim 14 comprising substantially matching a velocity at which the at least one additional fluid droplet is emitted into the second region with the second regional airflow velocity.

16. A method according to claim 1 wherein establishing a flow of air substantially collinear with a trajectory of fluid droplets emitted by each of one or more droplet emitters comprises forcing air past at least one surface and wherein the first region is between the at least one surface and a location of the maximum airflow velocity.

17. A method according to claim 16 wherein the at least one surface is a planar surface.

18. A method according to claim 16 wherein the at least one surface is an interior surface of a duct.

19. A method according to claim 18 wherein the duct is round in cross-section.

20. A method according to claim 18 wherein the duct is rectangular in cross-section.

21. A method according to claim 18 wherein the duct comprises opposing walls that converge as they extend in a direction of the flow of air.

22. A method according to claim 18 wherein the duct comprises opposing walls that diverge as they extend in a direction of the flow of air.

23. A method according to claim 1 wherein establishing a flow of air substantially collinear with a trajectory of fluid droplets emitted by each of one or more droplet emitters comprises forcing air between a pair of opposed surfaces.

24. A method according to claim 23 wherein the opposed surfaces converge as they extend in a direction of the flow of air.

25. A method according to claim 23 wherein the opposed surfaces diverge as they extend in a direction of the flow of air.

26. A method according to claim 1 wherein the flow of air is a laminar flow of air.

27. A method according to claim 1 wherein the flow of air comprises a laminar velocity profile.

28. A method for depositing fluid droplets on a surface, the method comprising:

establishing a substantially collinear flow of air; and emitting the fluid droplets from a plurality of nozzles into a region of the flow of air, the region having a regional airflow velocity lower than a maximum airflow velocity of the flow of air.

29. A method for depositing fluid droplets on a surface, the method comprising:

establishing a substantially collinear flow of air; and emitting the fluid droplets from a plurality of groups of nozzles into a plurality of regions of the flow of air, the plurality of regions each having a regional airflow velocity lower than a maximum airflow velocity of the flow of air and the plurality of regions each having a different regional airflow velocity.

30. An apparatus for depositing fluid droplets on a surface, the apparatus comprising:

an airflow duct;

means for establishing in the airflow duct a collinear airflow, the collinear airflow comprising:

(a) an airflow velocity profile with a maximum airflow velocity; and (b) a first region wherein the collinear airflow has a first regional airflow velocity, and at least one nozzle disposed to emit fluid droplets at a fluid droplet velocity into the first region.

31. The apparatus of claim 30, comprising a systems controller configured to at least substantially match the fluid droplet velocity and the first regional airflow velocity.

32. Apparatus according to claim 30 wherein the collinear airflow comprises a plurality of regions, each region having a regional airflow velocity lower than the maximum airflow velocity, and wherein the apparatus comprises a plurality of groups of nozzles, each group of nozzles comprising one or more nozzles disposed to emit fluid droplets into a corresponding one of the plurality of regions at a corresponding fluid droplet velocity.

33. Apparatus according to claim 32, comprising one or more systems controllers, the one or more systems controllers configured to match the fluid droplet velocity of the fluid droplets emitted by each of the groups of nozzles with the regional airflow velocity of the corresponding one of the plurality of regions.

34. Apparatus according to claim 33 wherein the plurality of regions comprises at least the first region and a second region having a second regional airflow velocity and wherein the first and second regional airflow velocities are substantially equal to one another.

35. Apparatus according to claim 33 wherein the plurality of regions comprises at least the first region and a second region having a second regional airflow velocity and wherein the first and second regional airflow velocities are different from one another.

36. Apparatus according to claim 32 wherein the groups of nozzles are disposed symmetrically with respect to the velocity profile.

37. Apparatus according to claim 32 wherein the fluid droplet velocity of the fluid droplets emitted by at least two of the groups of nozzles is substantially equal.

38. Apparatus according to claim 32 wherein the fluid droplet velocity of the fluid droplets emitted by at least two of the groups of nozzles is different.

39. Apparatus according to claim 30 wherein the collinear airflow comprises a plurality of regions, each region having a regional airflow velocity lower than the maximum airflow velocity, and wherein the apparatus comprises a plurality of rows of nozzles, each row of nozzles arranged to emit fluid droplets into a corresponding one of the plurality of regions at a corresponding fluid droplet velocity.

40. Apparatus according to claim 39 comprising one or more systems controllers, the one or more systems controllers configured to match the fluid droplet velocity of the fluid droplets emitted by each of the rows of nozzles with the regional airflow velocity of the corresponding one of the plurality of regions.

41. Apparatus according to claim 40 wherein the fluid droplet velocity of the fluid droplets emitted by at least two of the rows of nozzles is substantially equal.

42. Apparatus according to claim 40 wherein the fluid droplet velocity of the fluid droplets emitted by at least two of the rows of nozzles is different.

43. Apparatus according to claim 39 wherein the plurality of regions comprises at least the first region and a second region having a second regional airflow velocity and wherein the first and second regional airflow velocities are substantially equal to one another.

44. Apparatus according to claim 39 wherein the plurality of regions comprises at least the first region and a second region having a second regional airflow velocity and wherein the first and second regional airflow velocities are different from one another.

45. Apparatus according to claim 39 wherein the plurality of regions includes at least two regions having substantially equal regional airflow velocities.

46. Apparatus according to claim 39 wherein the plurality of regions includes at least two regions having different regional airflow velocities.

47. Apparatus according to claim 39 wherein the plurality of rows of nozzles are disposed symmetrically with respect to a location of the maximum airflow velocity in the velocity profile.

48. Apparatus according to claim 30 wherein the airflow duct comprises a round cross section.

49. Apparatus according to claim 30 wherein the airflow duct comprises a rectangular cross-section.

50. Apparatus according to claim 30 wherein the airflow duct comprises a pair of opposed surfaces.

51. Apparatus according to claim 50 wherein the opposed surfaces converge as they extend in a direction of the airflow.

52. Apparatus according to claim 50 wherein the opposed surfaces diverge as they extend in a direction of the airflow.

53. Apparatus according to claim 30 wherein the velocity profile comprises a laminar airflow velocity profile.

* * * * *